US007298087B2

(12) United States Patent
Kim et al.

(10) Patent No.: US 7,298,087 B2
(45) Date of Patent: Nov. 20, 2007

(54) PLASMA DISPLAY PANEL

(75) Inventors: Joong Kyun Kim, Seoul (KR); Sang Kook Lee, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 91 days.

(21) Appl. No.: 10/885,598

(22) Filed: Jul. 8, 2004

(65) Prior Publication Data

US 2005/0007017 A1 Jan. 13, 2005

(30) Foreign Application Priority Data

Jul. 8, 2003 (KR) ..... 10-2003-45935

(51) Int. Cl.
*H01J 17/49* (2006.01)

(52) U.S. Cl. ..... 313/587; 313/582

(58) Field of Classification Search ..... 313/582–587; 345/60; 445/23–25

See application file for complete search history.

(56) References Cited

U.S. PATENT DOCUMENTS 5,851,732 A * 12/1998 Kanda et al. ..... 430/321
6,727,648 B2 * 4/2004 Kang ..... 313/582
6,781,308 B2 * 8/2004 Hayashi ..... 313/582
6,855,196 B2 * 2/2005 Kawamura et al. ..... 106/31.6
6,870,316 B2 * 3/2005 Sano et al. ..... 313/583

FOREIGN PATENT DOCUMENTS

JP 10-125228 5/1998
KR 1020010007076 1/2001

* cited by examiner

*Primary Examiner*—Joseph Williams
(74) *Attorney, Agent, or Firm*—Ked & Associates, LLP

(57) ABSTRACT

A plasma display panel is provided which evenly deposits a phosphorus layer by forming a buffer layer before forming the phosphorus layer within a discharge cell of a rear surface substrate. The plasma display panel includes a front substrate on which are formed common sustain electrode and scan sustain electrodes and through which light is emitted and a rear substrate on which discharge cells are formed by barrier ribs and address electrodes. The rear substrate may be bonded to the front substrate by frit glass.

18 Claims, 3 Drawing Sheets

PLASMA DISPLAY PANEL

This application claims the benefit of the Korean Patent Application No. P2003-45935 filed on Jul. 8, 2003, which is hereby incorporated by reference.

BACKGROUND OF THE INVENTION

1. Field of the Invention

The present invention relates to a plasma display panel, and more particularly to a plasma display panel that is adaptive for evenly depositing a phosphorus layer by forming a buffer layer before the phosphorus layer is formed within a discharge cell of a rear surface substrate.

2. Description of the Related Art

Recently, Flat Panel Displays have briskly been developed, which include Liquid Crystal Displays (hereinafter 'LCD'), Field Emission Displays (hereinafter 'FED'), Plasma Display Panels (hereinafter 'PDP'). The PDP among them has advantages of easy production due to its simple structure, excellence of high brightness and high light-emission efficiency, memory function, and wide viewing angle of over 160°, in addition, being realized into a large screen of over 40 inches.

FIG. 1 is a diagram representing the structure of a three-electrode AC surface discharge PDP of prior art.

Referring to FIG. 1, the plasma display panel includes a front substrate 10 on which pictures are displayed and a rear substrate 20 which is formed separate from the front substrate 10 with a designated distance. The front and rear substrates are bonded and sealed by frit glass.

The front substrate 10 includes a common sustain electrode Z, scan sustain electrodes Y, a dielectric layer 12 and a protective layer 13. The common sustain electrode Z and the scan sustain electrodes Y are arranged in pair to keep the luminescence of cells by discharges between them. The dielectric layer 12 limits the discharge current of the common sustain electrode Z and the scan sustain electrode Y and makes each of the electrodes insulated. And, the protective layer 13 prevents damage of the dielectric layer 12 and makes the efficiency of secondary discharge improved.

The rear substrate 20 includes a plurality of address electrode X, a dielectric layer 22, barrier ribs 21 and a phosphorus layer 23 of each R, G, B. The address electrode X generates vacuum ultraviolet ray by performing address discharge at areas where the common sustain electrode Z and the scan sustain electrodes Y are crossed. The dielectric layer 22 makes the address electrodes X insulated. The barrier ribs 21 are formed on one side of the dielectric layer 22 to be arranged in parallel so as to form a plurality of discharge spaces, i.e., cells.

The phosphorus layer 23 of each RGB is deposited at an area between the side surface of the barrier ribs 21, one barrier rib and another barrier rib to emit visible ray.

Also, the common sustain electrode Z includes a transparent electrode Za of ITO electrode, a bus electrode Zb made of metal and a black layer B. The black layer B is formed between the common electrode Za and the bus electrode Zb and made of a conductive material such as ruthenium oxide and lead oxide or carbon family to improve the contrast.

Further, the scan sustain electrode Y includes a transparent electrode Ya of ITO electrode, a bus electrode Yb made of metal and a black layer B. The black layer B is formed between the common electrode Ya and the bus electrode Yb and made of a conductive material such as ruthenium oxide and lead oxide or carbon family to improve the contrast.

And, a discharge gas is filled between the front substrate 10 the rear substrate 20 at a pressure of 300~400 Torr. The discharge gas is mainly penning mixture gas and has He, Ne, Ar or their mixed gas as its buffer gas. A little of Xe gas is used as a source of vacuum ultraviolet ray which makes the phosphorus layer 23 emit light.

With the basis of the above-mentioned composition, the operation of the plasma display panel of prior art is described.

FIG. 2 is a diagram explaining the operation of the plasma display panel of prior art.

For reference, FIG. 2 is a diagram showing a rear substrate 20 in 90 angle to the front substrate for the sake of convenience of explanation.

Referring to FIG. 2, to describe the operation of the plasma display panel, the plasma display panel displays images by Address and Display Separate where a data input period and a display period are divided in time.

First of all, if a voltage of 150~300V is supplied between the san sustain electrode Y and the address electrode X in an arbitrary discharge cell, a writing discharge is generated inside the cell that is located between the scan sustain electrode Y and the address electrode X to form wall charges on the internal surface of the corresponding discharge cell, thereby leaving the wall charges on the dielectric layer 12.

In the cells selected by such an address discharge, a sustain discharge is generated by an AC signal supplied to the common sustain electrode Z and the scan sustain electrode Y, and the discharge causes electric fields to be generated within the cell, thereby accelerating micro-electrons among the discharge cell.

The accelerated electrons collide with neutrons among the gas to electrolytically dissociate them into electron and ion, and the dissociated electron makes another collision with other neutron, thereby causing the neutrons to be electrolytically dissociated into electron and ion more and more rapidly so that the discharge gas becomes in the state of plasma and, at the same time, vacuum ultraviolet ray is generated.

The ultraviolet ray generated in this way excites the R, G and B phosphorus layer 23 to generate visible ray, and the generated visible ray is irradiated to the outside, thus the luminescence of an arbitrary cell, i.e., the displayed image can be perceived from the outside.

Each cell that forms such an image constitutes a unit cell being separated from others by minute barrier ribs 21. In case of making the plasma display panel in real, it is not easy to form unit discharge cells of 100 μm on a glass substrate.

Especially, because high resolution plasma display panel is required recently, the size of discharge cell is further decreased and because the phosphorus layer is deposited over the decreased discharge cell, there occurs a problem of the phosphorus layer being deposited unevenly.

Since the phosphorus layer is deposited unevenly, there occurs a problem that the efficiency of converting the vacuum ultraviolet ray into the visible ray and decay time, i.e., time when the phosphorus is excited and light is emitted, become un-uniform in accordance with each discharge cell.

Furthermore, since the phosphorus layer is deposited unevenly, the life span of the phosphorus is deteriorated.

SUMMARY OF THE INVENTION

Accordingly, it is an object of the present invention to provide a plasma display panel that is adaptive for evenly depositing a phosphorus layer by forming a buffer layer before the phosphorus layer is formed within a discharge cell of a rear surface substrate.

In order to achieve these and other objects of the invention, a plasma display panel including a front substrate where a common sustain electrode and scan sustain electrodes are formed and light is emitted and a rear substrate where discharge cells are formed by barrier ribs and address electrodes are formed for address discharge, and wherein the rear substrate is bonded with the front substrate by frit glass, according to an aspect of the present invention includes a phosphorus layer deposited on a buffer layer and the upper part of the buffer layer in a discharge cell between the barrier ribs.

In the plasma display panel, the buffer layer is formed of oxide.

In the plasma display panel, the buffer layer is made of at least one or a combination of two or more among ZnO, Al-doped ZnO and In-doped ZnO.

In the plasma display panel, the buffer layer is made of CaO or BaO.

In the plasma display panel, the buffer layer is formed in a thickness of around 10~20 μm.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
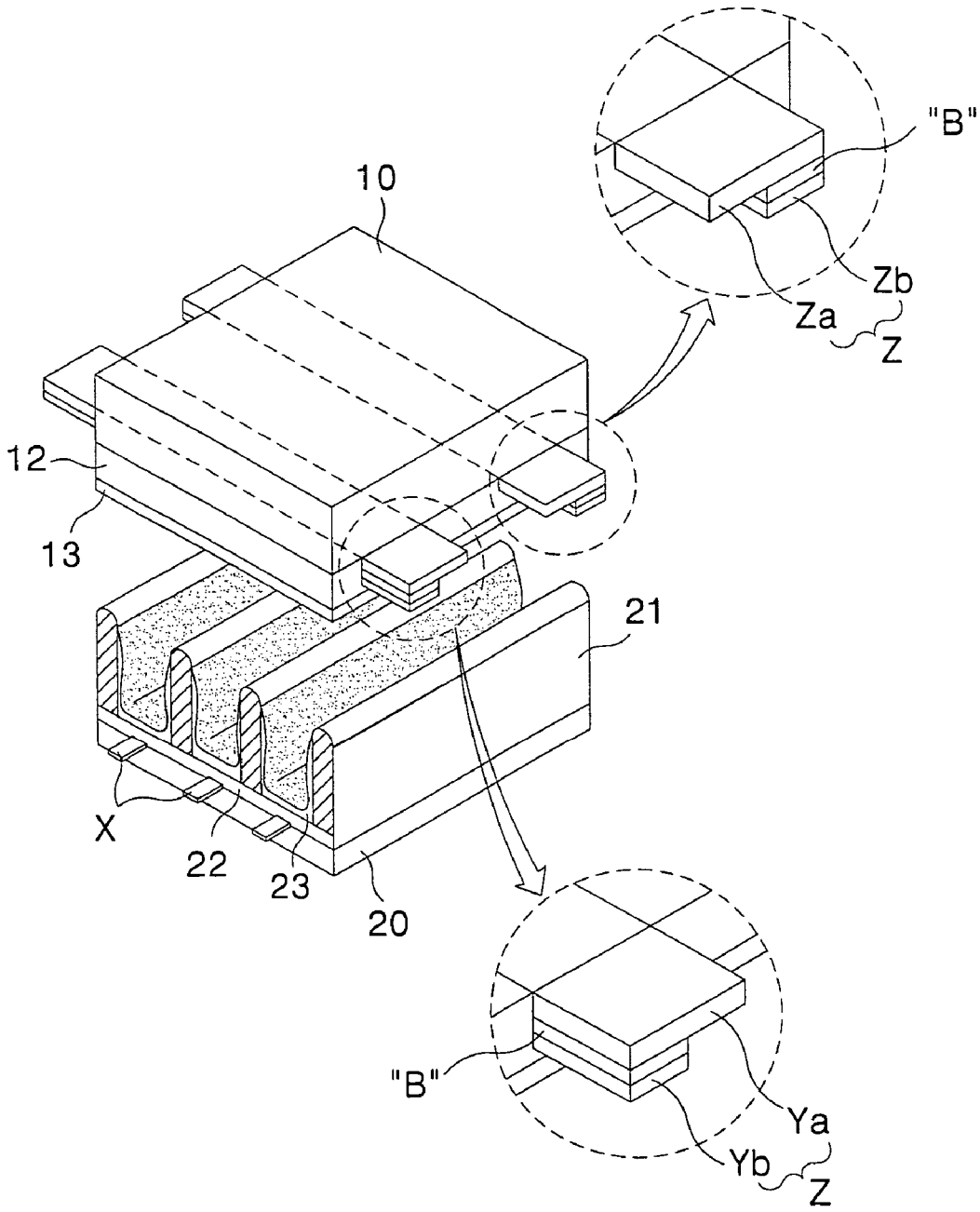
FIG. 1 RELATED ART
FIG. 1 is a diagram describing the structure of a three-electrode AC surface discharge plasma display panel of prior art.
Figure 2:
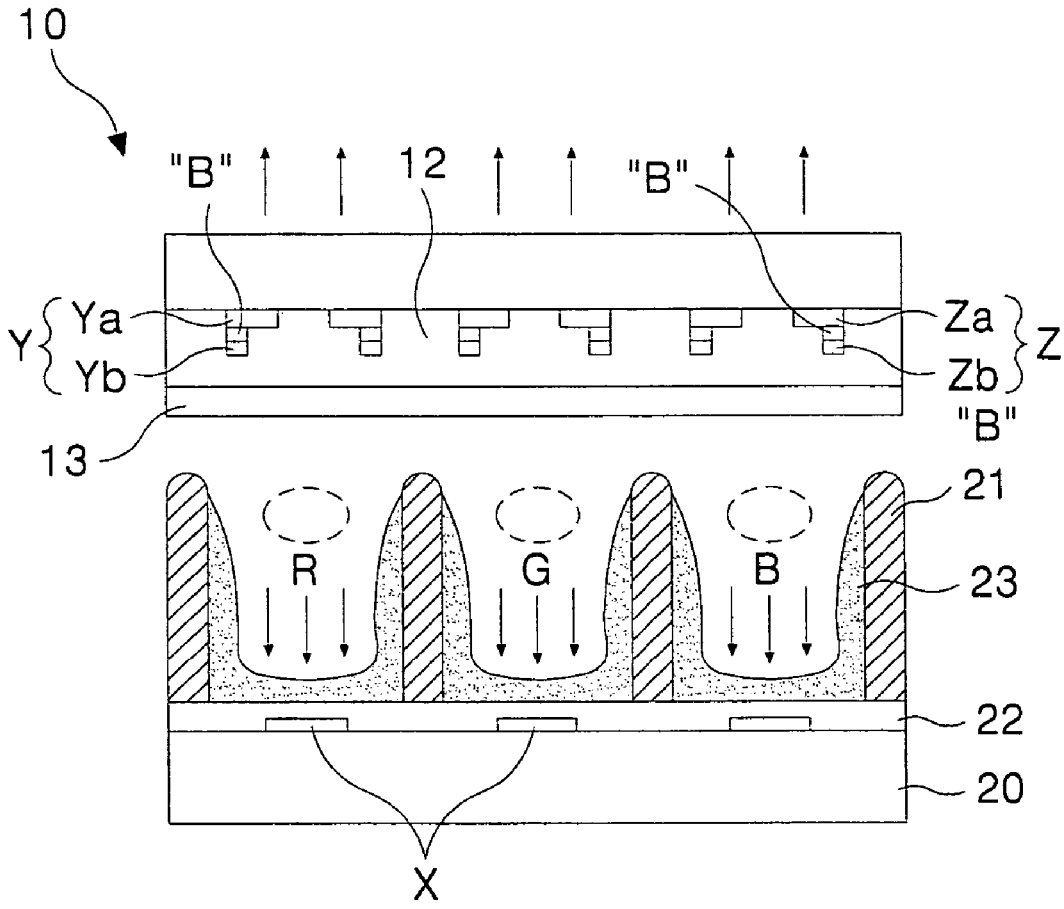
FIG. 2 RELATED ART
FIG. 2 is a diagram describing the operation of the plasma display panel of prior art.
Figure 3:
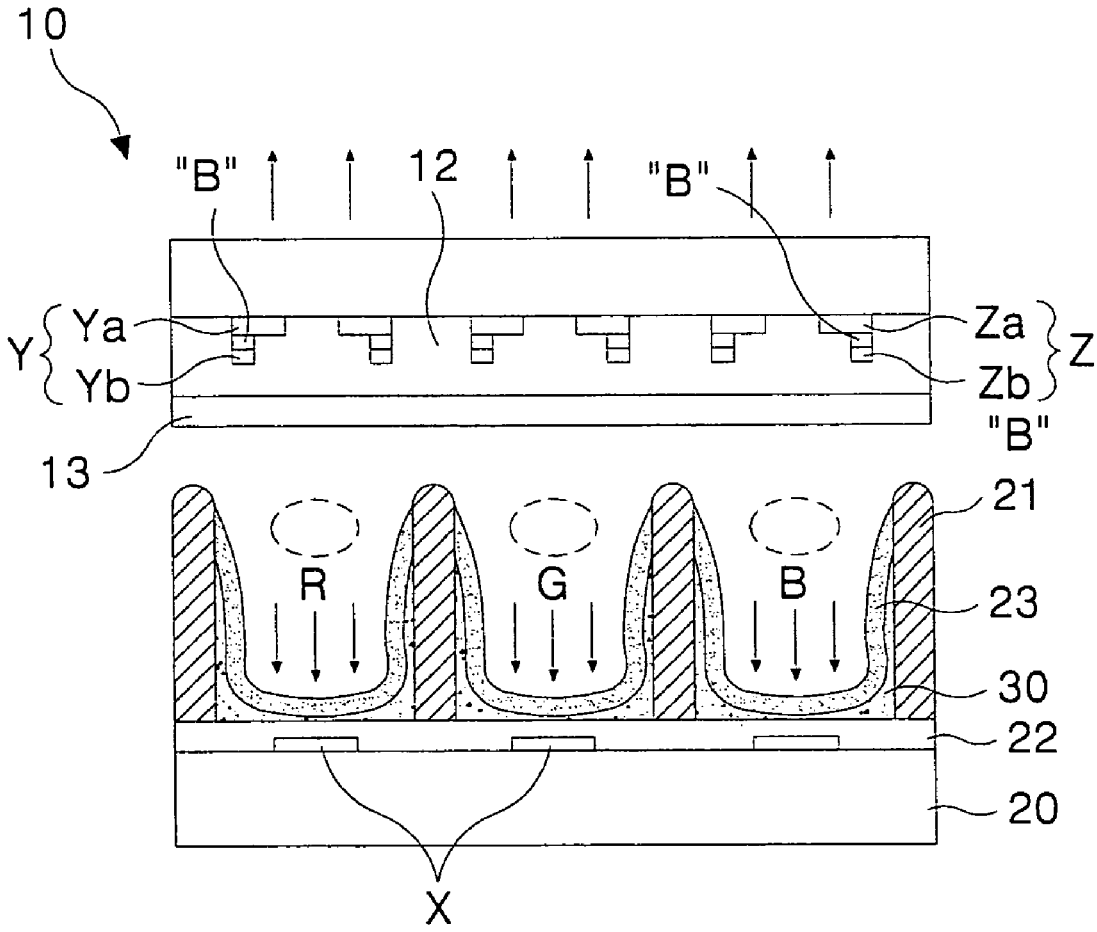
FIG. 3 is a diagram describing that a buffer layer is formed in a plasma display panel according to the present invention.

With reference to FIG. 3, embodiments of the present invention will be explained as follows.

FIG. 3 is a diagram describing a plasma display panel according to the present invention.

Referring to FIG. 3, the plasma display panel according to the present invention includes a front substrate 10 on which pictures are displayed and a rear substrate 20 which is formed separate from the front substrate 10 with a designated distance. The front and rear substrates are bonded and sealed by frit glass.

The front substrate 10 includes a common sustain electrode Z, scan sustain electrodes Y, a dielectric layer 12 and a protective layer 13. The common sustain electrode Z and the scan sustain electrodes Y are arranged in pair to keep the luminescence of cells by discharges between them. The dielectric layer 12 limits the discharge current of the common sustain electrode Z and the scan sustain electrode Y and makes each of the electrodes insulated. And, the protective layer 13 prevents damage of the dielectric layer 12 and makes the efficiency of secondary discharge improved.

The rear substrate 20 includes a plurality of address electrode X, a dielectric layer 22, barrier ribs 21, a phosphorus layer 23 of each R, G, B, and a buffer layer 30. The address electrode X generates vacuum ultraviolet ray by performing address discharge at areas where the common sustain electrode Z and the scan sustain electrodes Y are crossed. The dielectric layer 22 makes the address electrodes X insulated. The barrier ribs 21 are formed on one side of the dielectric layer 22 to be arranged in parallel so as to form a plurality of discharge spaces, i.e., cells. The buffer layer 30 is deposited inside the cell before depositing the phosphorus layer 23 in order to enable the phosphorus layer 23 uniformly deposited.

The buffer layer 30 is of an oxide. And, as the buffer layer 30 is formed, the buffer layer 30 plays role of a medium or seed to make the deposition of the phosphorus layer 23 more uniform.

Especially, because high resolution plasma display panel is required recently, the size of discharge cell is further decreased and the phosphorus layer is deposited unevenly. The buffer layer 30 causes the phosphorus layer 23 to be deposited evenly, thereby improving the picture quality characteristic of the plasma display panel.

The buffer layer 30 is of an oxide. Especially, it is desirable to be composed of zinc oxide (at lease one or a combination of two or more among ZnO, Al-doped ZnO and In-doped Zno), CaO or BaO.

Also, the buffer layer 30 is desirable to be formed in the thickness of around 10~20 μm in light of securing the discharge space and uniformly depositing the phosphorus layer 23.

In this way, the phosphorus layer 23 can be induced to be evenly deposited by forming the buffer layer 30 before depositing the phosphorus layer 23. Thus, a variety of picture quality characteristics can be improved due to the uniform deposition of the phosphorus layer 23.

Especially, the buffer layer 30 also affects the residual image characteristic among the picture quality characteristics of the plasma display panel. The residual image duration is reduced to less than half of it when depositing the phosphorus layer after forming the buffer layer 30 than when depositing the phosphorus layer 23 without the buffer layer 30 as in the prior art.

As described above, the plasma display panel according to the present invention forms the buffer layer before depositing the phosphorus layer, thereby enabling the phosphorus layer to be deposited more uniformly.

Since the phosphorus layer is deposited uniformly, a variety of picture quality characteristics can be improved, and especially, the high resolution plasma display panel, considered as important recently, might be achieved in forming the phosphorus layer.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having a plurality of discharge cells, comprising:

a front substrate having a common sustain electrode and a scan sustain electrode formed thereon, wherein at least one of the common sustain electrode or scan sustain electrode includes a bus electrode and a transparent electrode, the bus electrode extending in a first direction and configured to be electrically coupled to the transparent electrode, and wherein a black layer is formed under the bus electrode;

a rear substrate having barrier ribs and address electrodes, the address electrodes extending in a second direction, the first and second directions being different; and a phosphorus layer deposited on a buffer layer in discharge cells between the barrier ribs, wherein the buffer layer has curved corners and tapered ends.

2. The plasma display panel according to claim 1, wherein the buffer layer is formed of oxide.

3. The plasma display panel according to claim 1, wherein the buffer layer comprises at least one or a combination of two or more among ZnO, Al-doped ZnO and In-doped ZnO.

4. The plasma display panel according to claim 1, wherein the buffer layer comprises CaO or BaO.

5. The plasma display panel according to claim 1, wherein the buffer layer has a thickness of around 10~20 μm.

6. The plasma display panel according to claim 1, wherein the buffer layer comprises at least one of ZnO, Al-doped ZnO, In-doped ZnO, CaO, or BaO.

7. The plasma display panel according to claim 1, wherein the rear substrate is bonded with the front substrate.

8. The plasma display panel according to claim 7, wherein the rear substrate is bonded with the front substrate by frit glass.

9. The plasma display panel according to claim 1, wherein the black layer underlays a full area underneath the bus electrode.

10. The plasma display panel according to claim 1, wherein the tapered ends of the buffer layer end below a top of the barrier ribs.

11. The plasma display panel according to claim 1, wherein the buffer layer is non-uniform in thickness.

12. The plasma display panel according to claim 1, wherein a bottom portion of the buffer layer differs in thickness from the corner portions.

13. The plasma display panel according to claim 1, wherein a bottom portion of the buffer layer differs in thickness from the tapered end portions.

14. The plasma display panel according to claim 1, wherein the black layer extends in the first direction.

15. The plasma display panel according to claim 1, wherein the transparent electrode has a rectangular shape with a first prescribed width and the bus electrode has a rectangular shape with a second prescribed width in the second direction, and wherein the first width is larger than the second width.

16. The plasma display panel according to claim 1, wherein the bus electrode partially overlaps the transparent electrode.

17. The plasma display panel according to claim 1, wherein each discharge cell is formed between adjacent barrier ribs extending in at least the second direction.

18. The plasma display panel according to claim 1, wherein the barrier ribs have a substantially constant width.

* * * * *